US010654701B2

(12) United States Patent
Cheney et al.

(10) Patent No.: US 10,654,701 B2
(45) Date of Patent: May 19, 2020

(54) ULTRA HIGH RATIO LIQUID DELIVERY SYSTEM

(71) Applicant: Global Agricultural Technology and Engineering, LLC., Vero Beach, FL (US)

(72) Inventors: Michael E. Cheney, Vero Beach, FL (US); Scott Ross, Sebastian, FL (US); John R. Newton, Vero Beach, FL (US)

(73) Assignee: Global Agricultural Technology and Engineering, LLC, Vero Beach, FL (US)

( * ) Notice: Subject to any disclaimer, the term of this patent is extended or adjusted under 35 U.S.C. 154(b) by 0 days.

(21) Appl. No.: 16/244,581

(22) Filed: Jan. 10, 2019

(65) Prior Publication Data

US 2019/0169012 A1 Jun. 6, 2019

Related U.S. Application Data

(63) Continuation of application No. 15/571,690, filed as application No. PCT/US2016/030950 on May 5, 2016.

(Continued)

(51) Int. Cl.
*B67D 1/00* (2006.01)
*B01F 5/04* (2006.01)

(Continued)

(52) U.S. Cl.
CPC ..... *B67D 1/0051* (2013.01); *B01F 3/0865* (2013.01); *B01F 5/0471* (2013.01);

(Continued)

(58) Field of Classification Search
CPC ..... B01F 3/08; B01F 3/0861; B01F 3/0865; B01F 3/0869; B01F 3/10; B01F 2003/105;

(Continued)

(56) References Cited

U.S. PATENT DOCUMENTS 1,947,851 A * 2/1934 Jewett ..... B01F 5/102 366/136
2,129,704 A * 9/1938 Meyer ..... F16L 37/22 285/33

(Continued)

FOREIGN PATENT DOCUMENTS

WO 2014197238 12/2014
WO WO 2014/197238 A1 * 12/2014 ..... B67D 1/00

OTHER PUBLICATIONS

International Preliminary Report on Patentability dated Nov. 7, 2017 in related PCT Application No. PCT/US2016/30950.

(Continued)

*Primary Examiner* — Patrick M. Buechner
(74) *Attorney, Agent, or Firm* — Gesmer Updegrove LLP

(57) ABSTRACT

A liquid dispensing system comprises a container enclosing a chamber. A flexible bag in the chamber contains a first liquid. First and second conduits are contained in the chamber. The first conduit connects the chamber to an outlet port in the container where the second conduit connects the bag to the first conduit. A supply source introduces a pressurized second liquid into the chamber. The first conduit serves to direct an existing flow of the second liquid from the chamber to the outlet port, with the pressurized second liquid serving to collapse the bag and expel the first liquid contained therein via the second conduit to the first conduit for mixture with the exiting flow of the second liquid. The second conduit lacks flow restrictions, such as metering orifices or the like.

20 Claims, 4 Drawing Sheets

Related U.S. Application Data

(60) Provisional application No. 62/157,569, filed on May 6, 2015.

(51) Int. Cl.

| | |
|---|---|
| ***B01F 15/02*** | (2006.01) |
| ***B01F 3/08*** | (2006.01) |
| ***B67D 7/02*** | (2010.01) |
| *B01F 3/10* | (2006.01) |
| *B67D 7/74* | (2010.01) |

(52) U.S. Cl.

CPC ..... *B01F 5/0486* (2013.01); *B01F 15/0224* (2013.01); *B01F 15/0238* (2013.01); *B67D 1/004* (2013.01); *B67D 1/0021* (2013.01); *B67D 7/0216* (2013.01); *B67D 7/0255* (2013.01); *B01F 2003/105* (2013.01); *B01F 2215/0022* (2013.01); *B67D 7/74* (2013.01); *B67D 2210/00163* (2013.01)

(58) Field of Classification Search

CPC ..... B01F 2215/0022; B01F 5/0403; B01F 5/0471; B01F 5/0486; B01F 5/0496; B01F 5/0498; B01F 15/0085; B01F 15/0224; B01F 15/0238; B01F 15/0256; B01F 15/0272; B01F 15/029; B01F 15/0479; G05D 11/02; G05D 11/03; G05D 11/006; B67D 1/004; B67D 1/0021; B67D 7/0255; B67D 1/0043; B67D 2001/0096; B67D 2001/0827; B67D 2001/0828; B67D 1/0462; B67D 1/202; B67D 1/204; B67D 1/1284; B67D 7/0216

See application file for complete search history.

(56) References Cited

U.S. PATENT DOCUMENTS 3,779,261 A * 12/1973 Zygiel ..... G05D 11/006 137/3
3,974,847 A * 8/1976 Hodges ..... C02F 1/686 137/101.11
3,996,953 A * 12/1976 Scragg ..... B01F 5/0496 137/101.11
4,112,964 A * 9/1978 Banks ..... A01M 7/0092 137/205.5
4,210,175 A * 7/1980 Daniels ..... B05B 7/28 137/564.5
4,386,634 A * 6/1983 Stasz ..... A61M 1/1656 141/10
4,736,769 A * 4/1988 Belanger ..... A01K 7/02 137/564.5
4,804,065 A * 2/1989 Scragg ..... B01F 5/0496 184/39
4,974,634 A * 12/1990 Agulia ..... A01C 23/042 137/564.5
5,009,848 A * 4/1991 Secretarski ..... B01J 4/008 123/41.01
5,094,269 A * 3/1992 Agulia ..... A01C 23/042 137/564.5
6,227,262 B1 * 5/2001 Kohl ..... A47L 11/03 141/100
2003/0189063 A1 * 10/2003 Clark ..... B01F 15/0462 222/145.1
2005/0042122 A1 2/2005 Arghyris et al.
2006/0086753 A1 * 4/2006 Newton ..... B01F 5/0496 222/105
2006/0191824 A1 * 8/2006 Arett ..... A47G 19/12 210/85
2010/0000609 A1 * 1/2010 Goody ..... G05D 11/006 137/7
2015/0003674 A1 2/2015 Hertensen
2016/0107873 A1 * 4/2016 Callaghan ..... B67D 1/0035 222/94

OTHER PUBLICATIONS

International Search Report and Written Opinion dated Aug. 4, 2016 in related PCT Application No. PCT/US2016/30950.

Communication pursuant to Rule 164(1) EPC dated Nov. 22, 2018 in related EP Application No. 16790074.5.

* cited by examiner

ULTRA HIGH RATIO LIQUID DELIVERY SYSTEM

REFERENCE TO RELATED APPLICATION

This application is a continuation of U.S. patent application Ser. No. 15/571,690, filed Nov. 3, 2017, which claims priority to a 371 of PCT/US2016/30950, filed May 5, 2016, which claims priority to Provisional Patent Application No. 62/157,569, filed May 6, 2015, their contents and substance of which are herein incorporated by reference.

BACKGROUND DISCUSSION

U.S. Pat. No. 7,451,895 discloses a liquid dispensing system comprising a container containing at least one flexible bag. A first liquid is contained in the bag. A manifold chamber is in communication with the bag via a first metering orifice, and with the interior of the container via a second metering orifice. A second liquid is introduced under pressure into the container. The thus introduced second liquid serves to pressurize the first liquid in the bag, with the first and second metering orifices serving to respectively admit metered amounts of the first and second liquids into the manifold chamber for combination into a liquid mixture dispensed through an outlet. The metering orifices constrict flow and are prone to blockage when processing syrups and the like with elevated viscosities and/or high levels of suspended solids.

FIELD OF THE INVENTION

This invention relates generally to liquid delivery systems, and is concerned in particular with a portable system capable of delivering an on demand high ratio mixture of at least two liquids, with at least one of the liquids having an elevated viscosity and/or a high level of suspended solids.

SUMMARY OF THE INVENTION

In accordance with one aspect of the present invention, a liquid dispensing system comprises a container enclosing a chamber. A flexible bag in the chamber contains a first liquid. First and second conduits are located in the chamber. The first conduit connects the chamber to an outlet port in the container wall, and the second conduit connects the bag to the first conduit.

A supply source introduces a pressurized second liquid into the chamber. The first conduit serves to direct an exiting flow of the second liquid from the chamber to the outlet port, with the pressurized second liquid serving to collapse the bag and expel the first liquid contained therein via the second conduit to the first conduit for mixture with the exiting flow of the second liquid.

The first liquid may typically comprise a high viscosity beverage concentrate, and the second liquid may comprise municipal tap water.

The supply source of the liquid dispenser system may include a constant flow valve located externally of the container.

The liquid dispenser may further comprise check valves in one or both of the first and second conduits for preventing a reverse flow of liquid into said chamber.

The first conduit may include a metering orifice. However, the second conduit does not include any flow restriction devices such as metering orifices.

The first conduit may communicate with an upper region of the chamber, and the pressurized liquid may be introduced into a lower region of the chamber via an inlet port in the container.

A third open ended bypass conduit may be arranged between the container wall and the bag, and may extend from the lower region to the upper region of the chamber.

A liquid dispensing system in accordance with another aspect of the present invention may comprise a container enclosing a chamber having upper and lower region.

A flexible bag in the chamber extends vertically between the upper and lower regions.

A first liquid is contained in the bag, and first, second and third conduits are arranged in the chamber. The first conduit leads to an outlet port in the container wall. The second conduit connects the bag to the first conduit.

A supply source introduces a pressurized second liquid into the chamber and separately into the third conduit for delivery to the first conduit. The first conduit serves to direct an exiting flow of the second liquid to the outlet port, with the pressurized second liquid in the chamber serving to collapse the bag and expel the first liquid contained therein via the second conduit to the first conduit for mixture with the exiting flow of the second liquid.

The pressurized liquid may be introduced into a T-fitting in the chamber. The T-fitting has one branch communicating with the third conduit and another branch communicating with the chamber.

DETAILED DESCRIPTION

Figure 1:
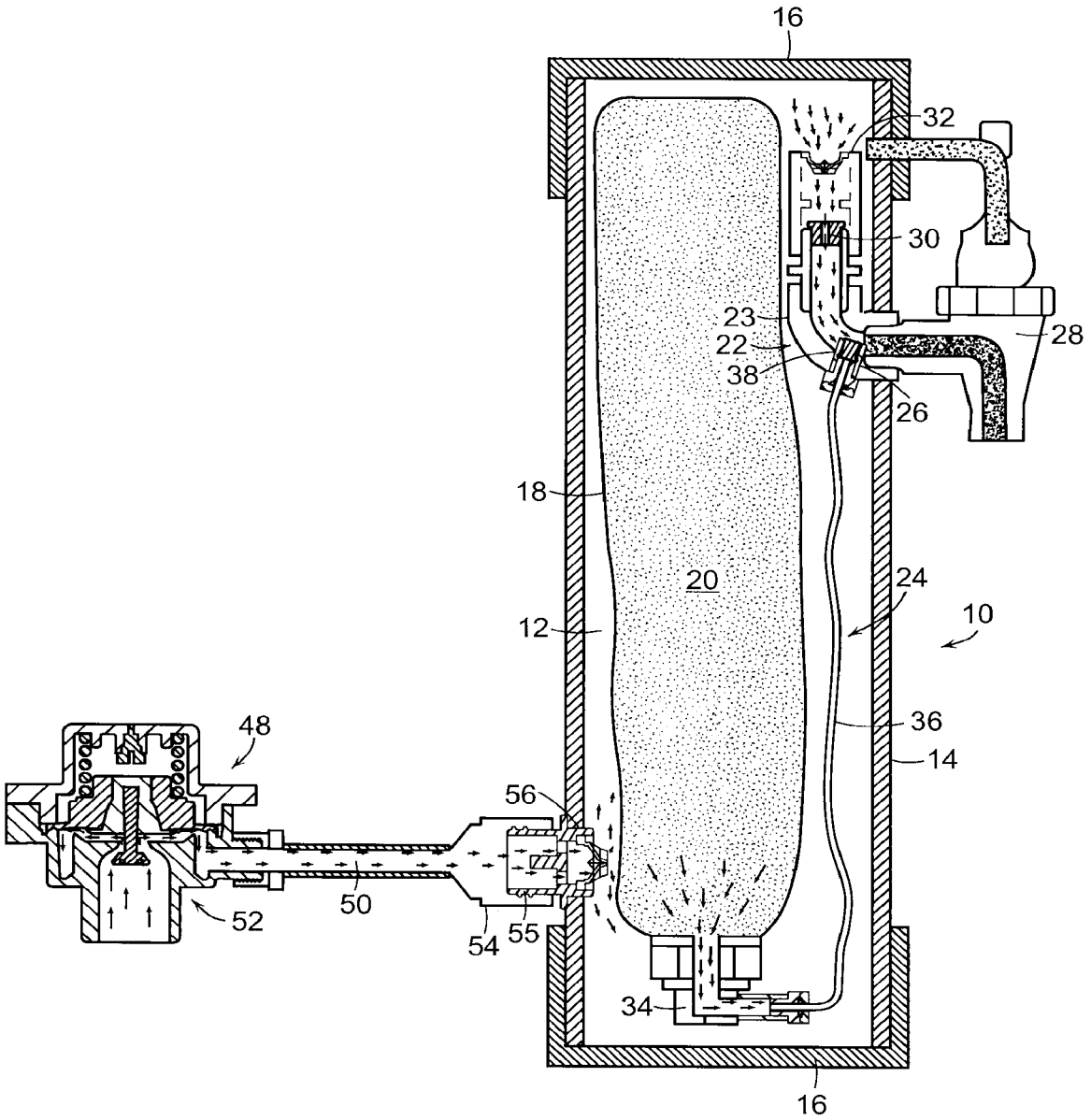
FIG. 1 is a diagrammatic illustration of an exemplary embodiment of a liquid delivery system in accordance with the present invention.

An exemplary embodiment of a liquid delivery system embodying aspects of the present invention is depicted in FIG. 1.

The system comprises a container 10 enclosing a chamber 12. The container may advantageously comprise a tubular wall 14 closed at its opposite ends by caps 16.

At least one flexible and collapsible bag 18 is contained in the chamber 12. The bag 18 typically will contain a first liquid 20, which may comprise a high viscosity beverage concentrate, for example a tea concentrate.

First and second conduits 22, 24 are located in the chamber 12. The first conduit 22 may typically include an elbow fitting 23, one end of which communicates with an outlet port 26 in the container wall 14. The outlet port 26 may lead to an on/off faucet 28 or other like dispenser. The dispenser may be manually operable, as shown, or of any known remotely operable type.

The first conduit 22 may additionally include an orifice 30 fitted to the opposite end of the elbow fitting 23, and a check valve 32. It will thus be seen that the first conduit 22, which as shown includes the elbow fitting 23, orifice 30 and check valve 32, provides a connection between the chamber 12 and the outlet port 26, which in turn communicates with the dispensing faucet 28.

The second conduit 24 may include an L-shaped fitting 34 closing the bottom open end of the bag 18, and a flexible tube 36 communicating at its opposite ends with the fitting 34 and the interior of the elbow fitting 23.

A check valve 38 may be included in the tube 36. The second conduit 24, which includes the fitting 34, tube 36 and check valve 38 thus connects the bag 18 to the first conduit 22, with such connection being achieved entirely within the confines of chamber 12.

Figure 2A:
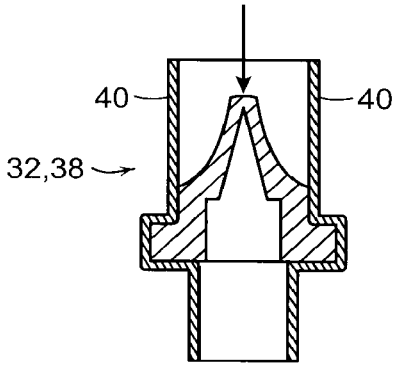
FIGS. 2A and 2B are illustrations depicting a typical check valve useful in the liquid delivery system of the present invention.
Figure 2B:
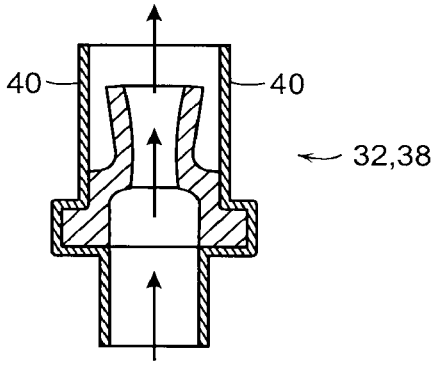

At least one and advantageously both of the check valves 32, 38 may comprise so called "duckbill valves", an exemplary embodiment of which is depicted in FIGS. 2A and 2B. Duckbill valves comprise one-piece elastomeric components that act as backflow prevention devices. They include elastomeric lips 40 in the shape of a duckbill which as shown in FIG. 2A, are closed by a backflow, and as shown in FIG. 2B, are opened by a forward flow. Although not shown, it is to be understood that other known check valves may be substituted for the disclosed duckbill valves.

Figure 3:
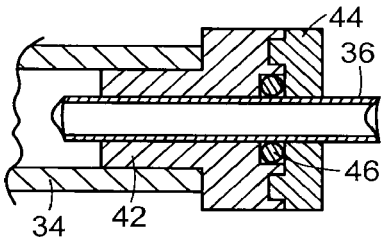
FIGS. 3 and 4 are enlarged views of portions of the system depicted in FIG. 1.

With reference to FIG. 3, it will be seen that the lower end of the flexible tube 36 is sealingly connected to the fitting 34 by means of an insert 42 coacting with cap 44 to compress an O-ring 46 around the tube. A similar arrangement may sealingly connect the upper end of the tube 36 to the elbow fitting 23.

The flexible tube 36 provides a smooth continuous connection between the fittings 34 and 23, without any internal restrictions of the type provided by metering orifices or the like.

A supply source 48 serves to introduce a pressurized second liquid 50 into the chamber 16. The second liquid may typically comprise tap water drawn from a municipal supply system.

Figure 4:
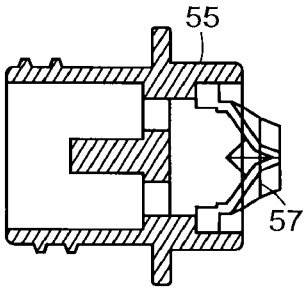

Advantageously, the supply source 48 may include a constant flow valve 52 connected by means of a dry breakquick connect coupling 54 to a nipple 55 projecting from an inlet port 56 in the container wall 14. As can best be seen in FIG. 4, the nipple 55 may be provided with a duckbill check valve 57.

As herein employed, the term "constant flow valve" means a flow control valve of the type described, for example, in any one of U.S. Pat. Nos. 7,617,839; 6,026,850 or 6,209,578, the descriptions of which are herein incorporated by reference in their entirety. These types of valves are normally closed, are opened in response to pressures exceeding a lower threshold level, are operative at pressures between the lower threshold level and an upper threshold level to deliver liquids at a substantially constant pressures, and are again closed at pressures above the upper threshold level.

When the faucet 28 is opened, the first conduit 22 serves to direct an exiting flow of the pressurized second liquid 50 (water) from the chamber 12 through the outlet port 26. The pressurized second liquid in the chamber 12 also serves to collapse the bag 18, causing the first liquid 20 (beverage concentrate) to be expelled via the second conduit 24 for injection into the exiting flow of the second liquid in the elbow fitting 23 of the first conduit 22. Injection of the first liquid into the exiting flow of the second liquid resists layering of the first liquid and thereby promotes mixture of both liquids.

Figure 5:
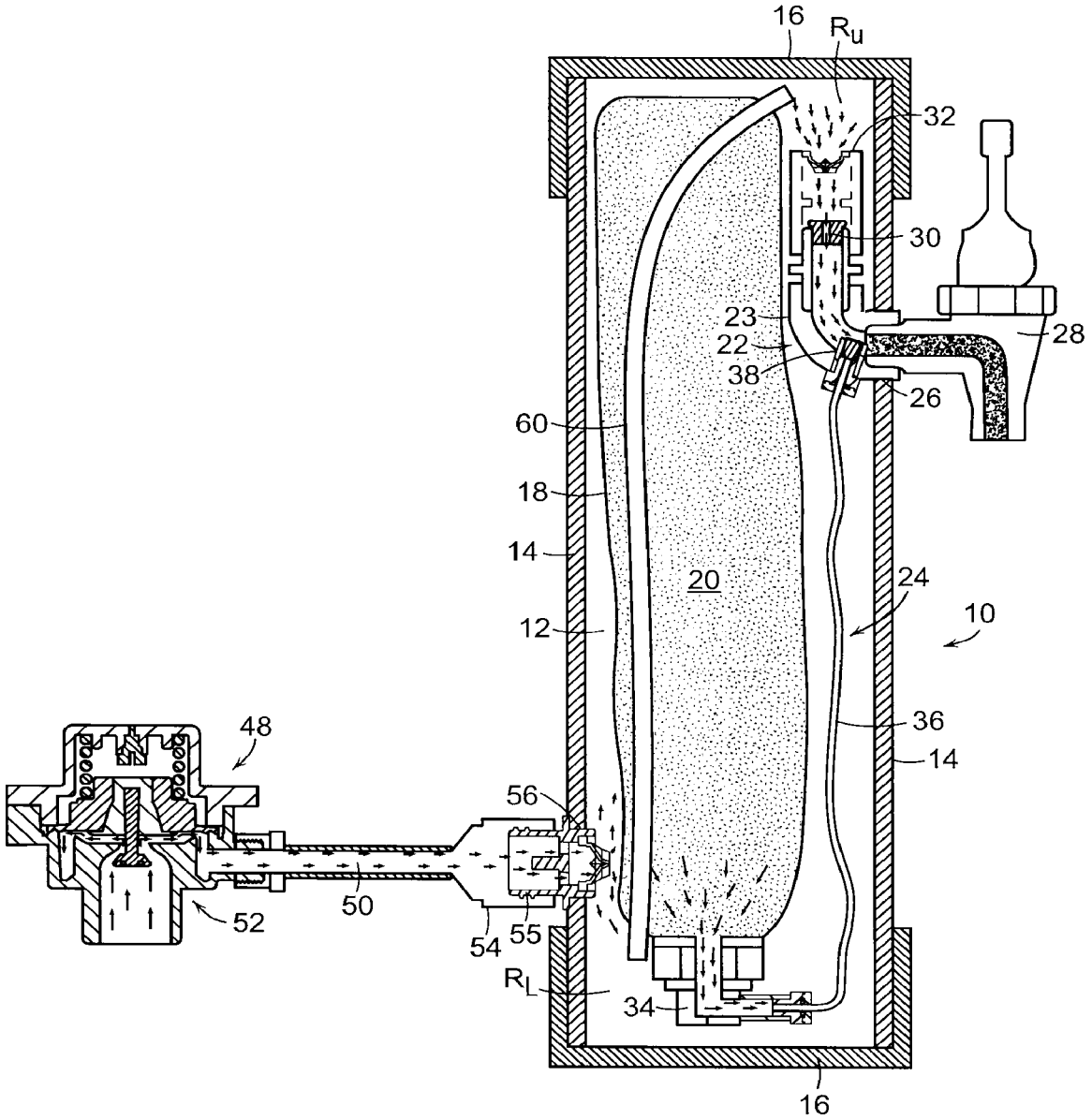
FIG. 5 is a diagrammatic illustration of a second exemplary embodiment of a liquid delivery system in accordance with the present invention.

In accordance with a second aspect of the present invention, and as depicted in FIG. 5, a third open ended bypass conduit. 60 is arranged between the interior of container wall 14 and the bag 18. Conduit 60 extends between upper and lower regions $R_U$, $R_L$ of the chamber 12. In the event that during usage of the system, the bag 18 should collapse against the container wall 14, the tube will continue to ensure delivery of the second liquid to the upper chamber $R_U$.

Figure 6:
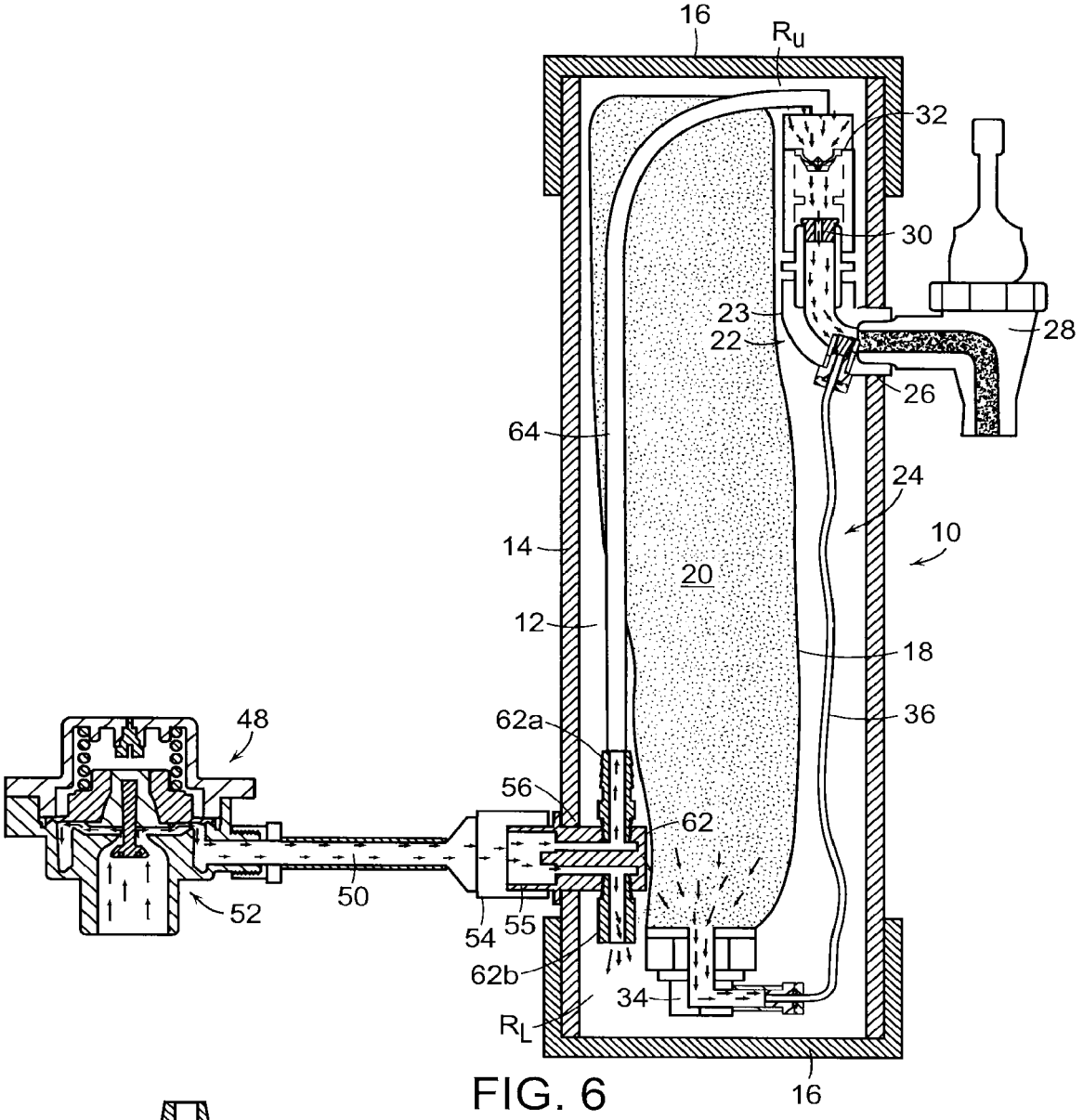
FIG. 6 is a diagrammatic illustration of a third exemplary embodiment of a liquid delivery system in accordance with the present invention.
Figure 7:
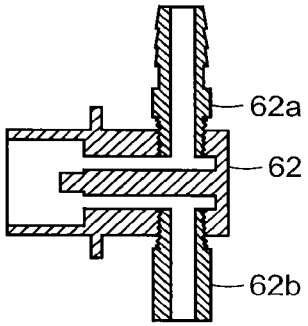
FIG. 7 is an enlarged view of the T-shaped fitting shown in FIG. 6.

In accordance with a third aspect of the present invention, as depicted in FIGS. 6 and 7, the second pressurized liquid 50 is introduced into a T-shaped fitting 62 located in the lower region $R_L$ of chamber 12. Fitting 62 has one branch 62*a* communicating with the lower end of a third conduit 64 and another branch 62*b* communicating with the lower region $R_L$ of chamber 12. The upper end of conduit 64 is connected directly to the first conduit 22 in the upper region $R_U$ of the chamber 12.

With this arrangement, the second liquid 50 is delivered to conduit 60 separately from that being delivered to the chamber 12.

The invention claimed is:

1. A liquid dispensing system comprising:

a first container (10) enclosing a chamber (12);

a flexible container (18) in the chamber (12);

a first liquid (20) contained in the flexible container (18);

a first conduit (22) and a second conduit (24) in the chamber (12), the first conduit (22) connecting the chamber (12) to an outlet port (26) in the first container (10), the second conduit (24) connecting the flexible container (18) to the first conduit (22) where the second conduit (24) is coupled to the flexible container (18) at a flexible container outlet location, the flexible container outlet location being located at a bottom of the flexible container (18), wherein the second conduit (24) is connected to the chamber (12) via an orifice (30) and the output port (26); and supply source (48) for introducing a pressurized second liquid (50) into the chamber (12), the first conduit (22) serving to direct an exiting flow of the pressurized second liquid (50) from the chamber (12) to the outlet port (26), with the pressurized second liquid (50) serving to collapse the flexible container (18) and expel the first liquid (20) contained therein via the second conduit (24) to the first conduit (22) for mixture with the exiting flow of the pressurized second liquid (50).

2. The liquid dispensing system of claim 1 wherein the supply source (48) includes a constant flow valve (52) located external of the first container (10).

3. The liquid dispensing system of claim 1 wherein the first conduit (22) includes a metering orifice.

4. The liquid dispensing system of claim 1 wherein the second conduit (24) comprises a flexible tube (36).

5. The liquid dispensing system of claim 1, wherein the supply source (48) is connected to the container (10) by a dry breakquick connect coupling (54).

6. The liquid dispensing system of claim 1, wherein the second conduit (24) comprises an orifice fitted to an opposite end of an elbow fitting.

7. The liquid dispensing system of claim 1, wherein the second conduit (24) comprises a first check valve (32) to provide a connection between the chamber (12) and the outlet port (26).

8. The liquid dispensing system of claim 1, further comprising a first check valve (32) configured to prevent a reverse flow of liquid into the chamber (12) or further comprising a second check valve (38) on the second conduit (24) for preventing a reverse flow of liquid into the flexible container (18).

9. The liquid dispensing system of claim 8, wherein the first check valve (32) and the second check valve (38) comprise duckbill valves.

10. The liquid dispensing system of claim 1, wherein the first conduit (22) communicates with an upper region of the chamber (12), and wherein the pressurized second liquid (50) is introduced into a lower region of the chamber (12) via an inlet port (56) in the first container (10).

11. The liquid dispensing system of claim 10, further comprising a third open ended bypass conduit (60) arranged between an interior of the first container (10) and the flexible container (18), the third open ended bypass conduit (60) extending from the lower region ($R_L$) to the upper region ($R_U$) of the chamber (12).

12. A liquid dispensing system comprising:

a first container (10) enclosing a chamber (12);

a flexible container (18) in the chamber (12);

a first liquid (20) contained in the flexible container (18);

a first conduit (22) and a second conduit (24) in the chamber (12), the first conduit (22) connecting the chamber (12) to an outlet port (26) in the first container (10), the second conduit (24) connecting the flexible container said bag (18) to the first conduit (22) where the second conduit (24) is coupled to the flexible container (18) at a flexible container outlet location, the flexible container outlet location being located at a bottom of the flexible container (18);

supply source (48) for introducing a pressurized second liquid (50) into the chamber (12), the first conduit (22) serving to direct an exiting flow of the pressurized second liquid (50) from the chamber (12) to the outlet port (26), with the pressurized second liquid (50) serving to collapse the flexible container (18) and expel the first liquid (20) contained therein via the second conduit (24) to the first conduit (22) for mixture with the exiting flow of the pressurized second liquid (50); and one or more check valves for preventing a reverse flow of liquid into the chamber (12) or into the flexible container (18).

13. The liquid dispensing system of claim 12, wherein the supply source (48) includes a constant flow valve (52) located external of the container (10).

14. The liquid dispensing system of claim 12, wherein the first conduit (22) includes a metering orifice.

15. The liquid dispensing system of claim 12, wherein the second conduit (24) comprises a flexible tube (36).

16. The liquid dispensing system of claim 12, wherein the supply source (48) is connected to the first container (10) by a dry breakquick connect coupling (54).

17. The liquid dispensing system of claim 12, wherein the supply source is connected to the container by a dry quick-break connect coupling (54) to a nipple structure (55).

18. The liquid dispensing system of claim 12, further comprising:

a third open ended bypass conduit (60) arranged between an interior of the first container (10) and the flexible container (18), the third open ended bypass conduit (60) extending from the lower region ($R_L$) to the upper region ($R_U$) of the chamber (12); and a T-shaped fitting (62) located in the lower region of the chamber (12);

wherein the T-shaped fitting (62) is coupled to the third open ended bypass conduit (60) and the lower region of the chamber (12).

19. The liquid dispensing system of claim 12, wherein the first conduit (22) communicates with an upper region of the chamber (12), and wherein the pressurized second liquid (50) is introduced into a lower region of the chamber (12) via an inlet port (56) in the first container (10).

20. The liquid dispensing system of claim 19, further comprising a third open ended bypass conduit (60) arranged between an interior of the first container (10) and the flexible container (18), the third open ended bypass conduit (60) extending from the lower region ($R_L$) to the upper region ($R_U$) of the chamber (12).

* * * * *